United States Patent [19]

Okumoto

[11] Patent Number: 4,836,221

[45] Date of Patent: Jun. 6, 1989

[54] DEVICE FOR CONTROLLING CONTENTS OF TOBACCO ON CIGARETTE MANUFACTURING MACHINE

[75] Inventor: Yutaka Okumoto, Musashino, Japan

[73] Assignee: Japan Tobacco Inc., Tokyo, Japan

[21] Appl. No.: 116,016

[22] Filed: Oct. 30, 1987

[30] Foreign Application Priority Data

Oct. 31, 1986 [JP] Japan ..... 61-258185

[51] Int. Cl.[4] ..... A24C 5/14

[52] U.S. Cl. ..... 131/84.1; 131/84.4; 131/280; 131/905; 131/906

[58] Field of Search ..... 131/280, 84.1, 84.4, 131/905, 906

[56] References Cited

U.S. PATENT DOCUMENTS

| | | | |
|---|---|---|---|
| 2,861,683 | 11/1953 | Gilman . | |
| 2,937,280 | 5/1960 | Gilman . | |
| 2,938,521 | 5/1960 | Lanore | 131/24 |
| 2,954,775 | 10/1960 | Radley | 131/21 |
| 3,089,497 | 5/1963 | Molias | 131/21 |
| 3,288,147 | 11/1966 | Molins | 131/21 |
| 3,738,376 | 6/1973 | Labbe et al. | 131/84.4 |
| 4,036,238 | 7/1977 | Okumoto | 131/21 B |
| 4,236,534 | 12/1980 | Heitmann et al. | 131/280 |
| 4,423,742 | 1/1984 | Reuland | 131/84.4 |
| 4,595,027 | 6/1986 | Higgins et al. | 131/280 |
| 4,638,817 | 1/1987 | Okumoto | 131/280 |

FOREIGN PATENT DOCUMENTS

| | | | |
|---|---|---|---|
| 0160800 | 11/1985 | Japan | 131/280 |
| 60-234574 | 11/1985 | Japan . | |
| 945839 | 1/1964 | United Kingdom . | |

OTHER PUBLICATIONS

European Search Report. 3 pgs., EPAO 160 799.

*Primary Examiner*—V. Millin
*Assistant Examiner*—Joe H. Cheng
*Attorney, Agent, or Firm*—Ladas & Parry

[57] ABSTRACT

A device for controlling the content of tobacco in a cigarette machine, for feeding the tobacco content along an air-permeable conveyor band, trimming the tobacco content thereon, wrapping them in paper, thereby continuously producing stick-like cigarettes. The device comprises a first radiometric density detector, arranged in front of a trimming position, for detecting the density of the tobacco content; and a second radiometric density detector, for continuously detecting the densities of the stick-like cigarettes, wherein the sum signal representing an integrated value of outputs from the second radiometric density detector and an output from the first radiometric density detector is used to control the trimming and hence the tobacco content in the cigarette manufacturing machine.

7 Claims, 5 Drawing Sheets

DEVICE FOR CONTROLLING CONTENTS OF TOBACCO ON CIGARETTE MANUFACTURING MACHINE

BACKGROUND OF THE INVENTION

The present invention relates to a device for controlling the content of tobacco on a cigarette manufacturing machine and, more particularly, to a tobacco content control device which is capable of controlling the tobacco content constantly to a predetermined amount, so as to guarantee production of cigarettes having uniform tobacco content.

The reduction of total operating costs is a matter of the utmost importance to cigarette manufacturers, as this is a major factor in improving their profitability. Therefore, extensive studies have been carried out with a view to reduce operating costs as much as possible.

One way of reducing operating costs is to enhance the productivity of the cigarette manufacturing machines. From this viewpoint, technical developments have almost reached the point where a single cigarette manufacturing machine can now produce as many as 8,000 cigarettes per minute.

Another way of reducing operating costs is to reduce the weight of the tobacco content of the individual cigarettes. When recent increases in the price of leaf tobacco are taken into consideration, the above approach can yield vast profits through a slight reduction of the tobacco content of each cigarette. However, unduly large reductions of the tobacco content make it difficult to maintain the required quality. Thus, the approach most widely adapted by cigarette manufacturers has been to reduce irregularities in the weight of the tobacco content of individual cigarettes, thereby decreasing the total amount of tobacco used in cigarette production.

More specifically, in the manufacture of cigarettes as currently carried out, the weight of the tobacco content of the cigarettes and a standard deviation corresponding to irregularities in the measured weight are measured, and the minimum allowable weight is the weight which indicates the minimum acceptable quality. The standard deviation is added to this minimum allowable weight and the sum is defined as the target value. The cigarettes are then manufactured on the basis of this target value. Therefore, by reducing irregularities in the tobacco content of the individual cigarettes, the target value in production, i.e., the total weight of tobacco used in cigarette production is necessarily reduced.

In order to reduce irregularities in the tobacco content, it is important to maintain the cigarette manufacturing machines in good operating condition, so as to preclude unintended movement of worn-out mechanical parts. However, the most effective measure, in this regard, is to add a tobacco content control device of high quality to the cigarette manufacturing machine. Accordingly, various conventional devices have been proposed in this connection.

For example, Japanese Patent Publication No. 40-14560 (U.S. Pat. No. 3,288,147) discloses a method of controlling the tobacco content on the basis of air permeability, utilizing the correlation between the weight of the tobacco content and their air permeability. However, this method is adversely affected by variations in the suction pressure, particle size, and composition of the tobacco. These variation tend to disturb the preestablished correlation between the weight and air permeability of the tobacco content. Therefore this method has failed to reduce irregularities in the tobacco content to any significant degree.

U.S. Pat. Nos. 2,937,280 and 2,861,683 disclose methods of controlling the tobacco content on the basis of electrostatic capacitance, utilizing the correlation between the tobacco content and their electrostatic capacitance. These methods are, however, susceptible to the influences of the moisture content of the tobacco and temperature, which bias the correlation between the tobacco content and their electrostatic capacitance. Accordingly, these methods do not contribute to the reduction of irregularities in the tobacco content to any substantial degree, and have almost no practical application.

Still another method of reducing irregularities in the weight of the tobacco content utilizes the correlation between the transmission factor of radiation rays, especially $\beta$ rays emitted from strontium 90, and the density of the tobacco. The tobacco content is controlled on the basis of the transmission factor of these rays. This method is, however, subject to such problems as safety in handling the radiation rays, drifting and the inferior response of an amplifier in a subsequent stage, due to the weakness of the output current of an ionization box which serves as a radiation ray detector. However, since there is a reliable correlation between the transmission factor of radiation rays and the tobacco content, this method is employed in most current cigarette manufacturing machines.

There are many causes for irregularities in the tobacco content of cigarettes, such as eccentricity of a cut tobacco feed drum, slippage of cut tobacco during its suction into a perforated cigarette belt, cluttering of a trimmer, nonuniform wear of a wall for stacking cut tobacco, and slippage during production of cigarettes. For this reason, according to frequency analysis of variations in signals corresponding to densities of stick-like cigarettes, various frequencies, from a low frequency of 0.001 Hz (long variation cycle) to a high frequency of 10 Hz or 100 Hz (short variation cycle), are continuously included, and thus a so-called "white noise" state results therefrom.

In order to reduce irregularities in the tobacco content of cigarettes, a fast response control device may be used to eliminate variations in density signals representing speeds lower than the response speed.

In the 1950s, a tobacco content control device utilizing a radiometric density detector was proposed for the above purpose. Extensive studies have been carried out since then, to improve the response speed of the device.

A device for controlling the tobacco content of cigarettes by utilizing radiation rays is described in U.S. Pat. No. 2,954,775. This device employs a method of controlling the feed speed of a cut tobacco feeder on the basis of a signal from the radiometric density detector. According to this method, however, the speed of a feeder having a large inertia must be controlled. Consequently, the response rate cannot be increased to a specific or higher value. As a result, the only weight variations eliminated using this device, are those corresponding to a low frequency of about 0.01 Hz or less.

In order to increase the response speed, Japanese Patent Publication No. 38-15949 (U.S. Pat. No. 3,089,497) proposes a method of controlling a transferred tobacco layer on the basis of a signal from a radiometric density detector. According to this method, a drive motor is rotated in the forward/reverse direction to move the trimmer, in order to control the amount of tobacco. The trimmer presents a relatively small inertia when it is moved. In addition, the time interval (i.e., the delay time) from weight change detection by the radiation ray detector to the driving of the trimmer is relatively short. For these reasons, a response speed higher than is attainable by use of other methods can be obtained, in this case, with variations in frequencies of 0.1 Hz or less being almost entirely eliminated. Consequently, this method is employed in most current cigarette manufacturing machines.

Japanese Patent Publication No. 51-95198 (U.S. Pat. No 4,036,238) proposes a method of utilizing an electrohydraulic servo mechanism for moving the trimmer up and down, instead of the motor for driving the trimmer which is disclosed in the above-described method. According to the improved method, weight variation corresponding to a low frequency of about 0.5 Hz or less can be eliminated.

U.S. patent application Ser. No. 705,877, filed Feb. 27, 1985 now U.S. Pat. No. 4,766,910 (corresponding to Japanese Patent Disclosure (Kokai) No. 60-234574 and EPC Laid Open Publication No. 160,799) proposes a method of minimizing the delay time by arranging another radiometric density detector immediately behind the trimmer. This method permits the elimination of variations in frequencies of 1 Hz or less.

However, development of these high-speed devices has, instead of satisfying demand, merely created further, strong demand for the development of a tobacco content control device of even higher speed and higher performance.

SUMMARY OF THE INVENTION

It is an object of the present invention to provide a high-performance tobacco content control device for a cigarette manufacturing machine, wherein variations in frequencies of 10 Hz or less can be almost entirely eliminated.

According to the present invention, a device is provided for controlling the content of tobacco in a cigarette machine, which feeds the tobacco content along an air-permeable conveyor band, trims the tobacco content on the conveyor band, wraps them in a sheet, thereby continuously producing stick-like cigarettes. This device comprises: a first radiometric density detector arranged in front of a trimming position, for detecting the density of the tobacco content; and a second radiometric density detector, for continuously detecting the densities of the stick-like cigarettes, wherein the sum signal representing an integrated value of outputs from the second radiometric density detector and an output from the first radiometric density detector is used to control the trimming and hence the tobacco content in the cigarette manufacturing machine.

More specifically, the tobacco content control device according to the present invention comprises a feedback closed loop control system which constitutes the second radiometric density detector for detecting the densities of the stick-like cigarettes, an electrohydraulic servo mechanism which serves as an operation terminal above to respond at high speed, and a feed-forward open lop control system which constitutes the first radiometric density detector for detecting the density of the tobacco layer.

With the above arrangement, the feature of feedback control of the second radiometric density detector is advantageously combined with the feature of feedforward control of the first radiometric density detector, thereby providing a control system which can respond at high speed to a detection signal.

DETAILED DESCRIPTION OF THE PREFERRED EMBODIMENT

A preferred embodiment of the present invention will be described with reference to the accompanying drawings.

Figure 1:
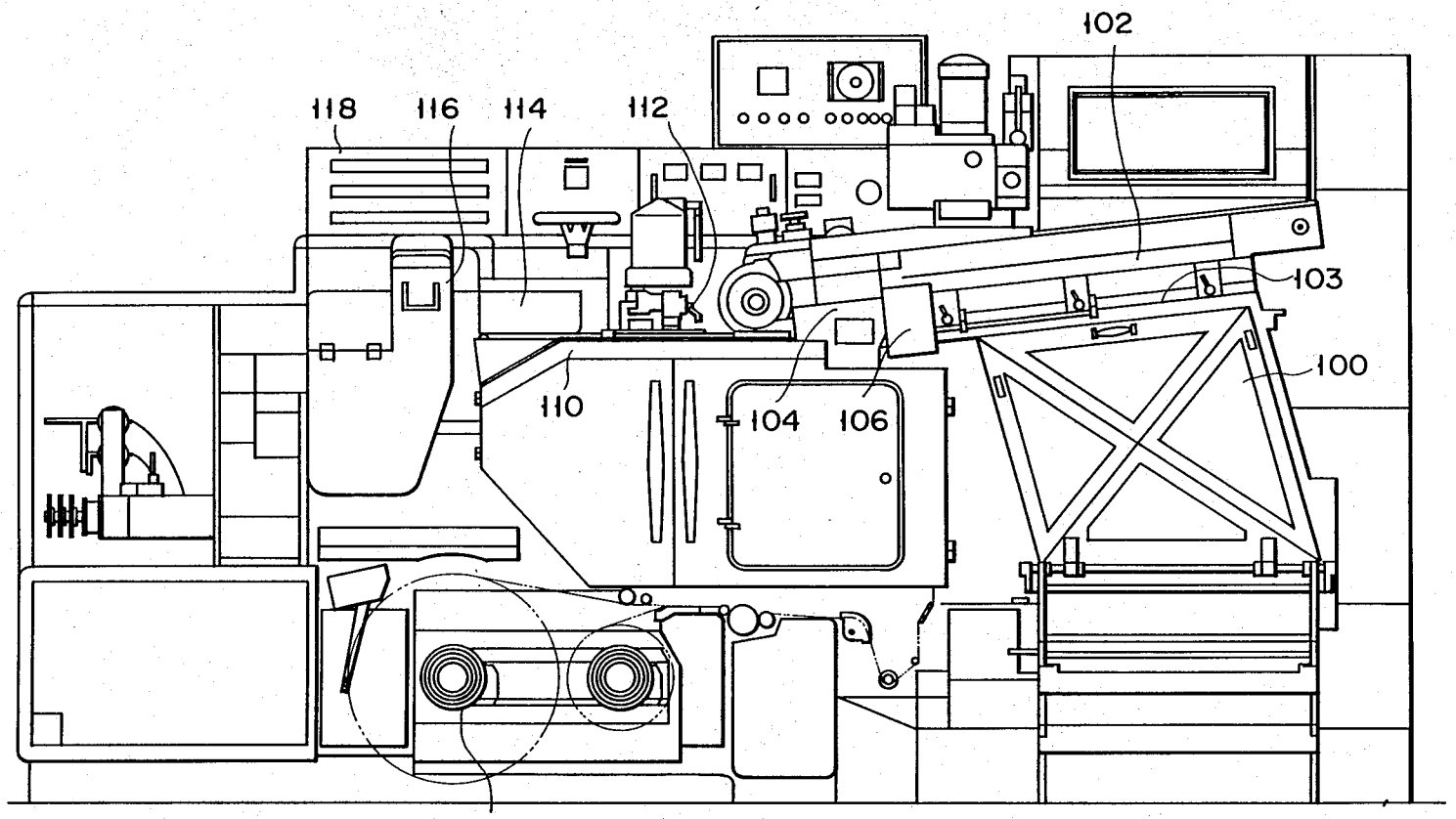
FIG. 1 is a front view of a cigarette manufacturing machine comprising a tobacco content control device according to an embodiment of the present invention.

FIG. 1 is a cigarette manufacturing machine comprising tobacco content control devices according to an embodiment of the present invention. In the cigarette manufacturing machine shown in FIG. 1, cut tobacco is sucked upward through chimney 100 and adhered by suction to the lower side of perforated cigarette conveyor 103 which is located beneath suction chamber 102. The adhered tobacco layer is transferred to the left in the drawing toward trimmer 104. The density of the tobacco layer is measured by first radiometric density detector 106 located in the upstream side of trimmer 104. The thickness of the cut tobacco layer is adjusted to a proper thickness by trimmer 104. The cut tobacco layer having the proper thickness is transferred onto and rolled in cigarette paper which is fed from paper roll 108 and stacked on cloth tape 110. The cigarette paper is glued by glue applicator 112 and the glued portions are dried by heater 114 to form a stick-like cigarette. The thus formed stick-like cigarette is transferred to the left and passed through second radiometric density detector 116 to check its density and to cut the cigarettes into the required length with cutter 118. The cigarettes from cutter 118 are transferred to a tray by a conveyor (not shown).

Figure 2:
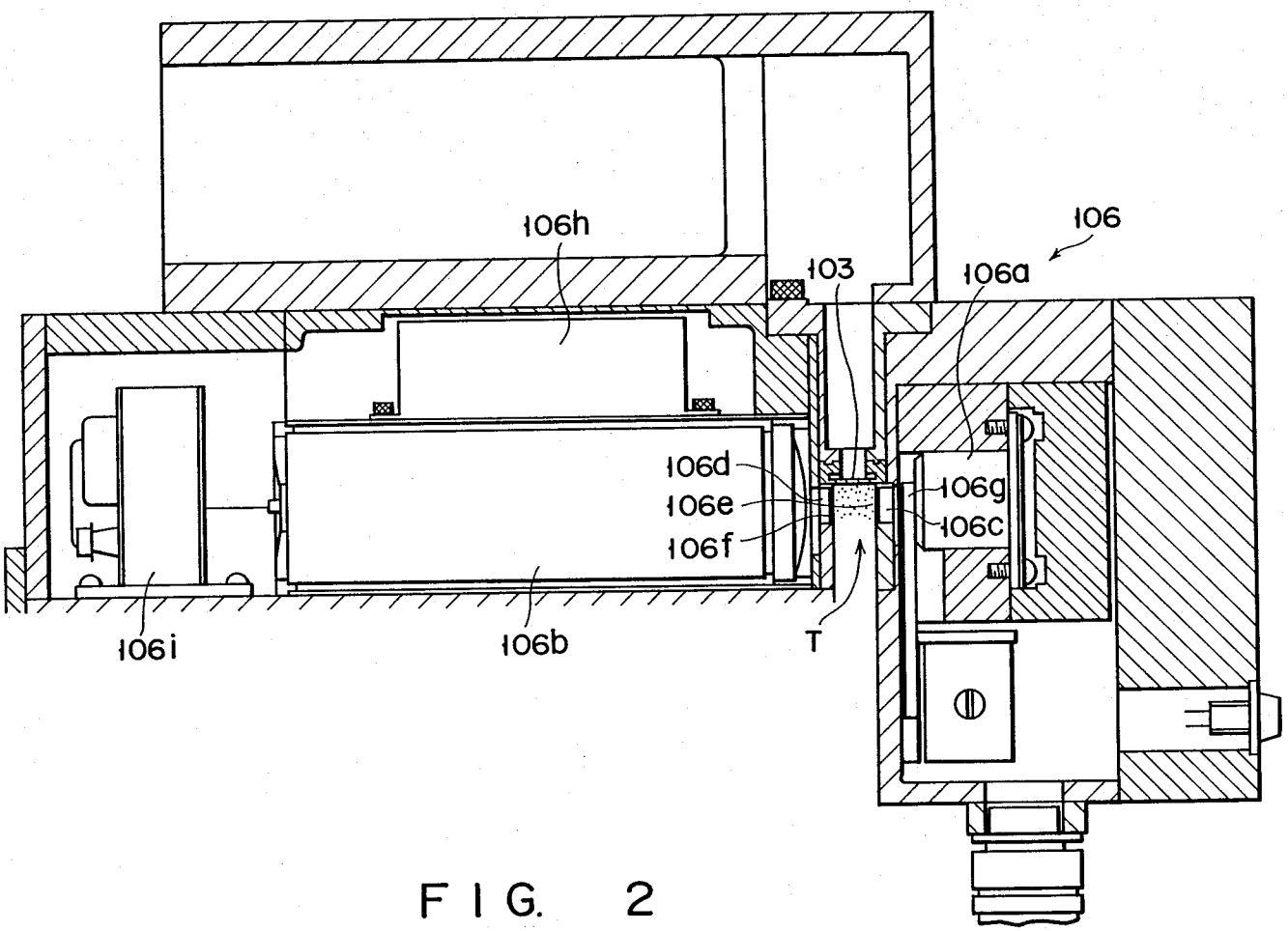
FIG. 2 is a sectional view of a first radiometric density detector shown in FIG. 1.

FIG. 2 shows the construction of first radiometric density detector 106. Detector 106 mainly comprises radiation source **106*a* which emits radiant rays, and ionization box 106*b* which receives the radiant ray from radiation source 106*a*. Radiation source 106*a* and ionization box 106*b* are spaced apart from each other by a predetermined distance. Aperture windows 106*c* and 106*d* are located between ionization box 106*b* and radiation source 106*a* and serve as a radiation path. Aperture windows 106*c* and 106*d* oppose each other and are spaced apart from each other by a predetermined distance. Metal films 106*e* and 106*f*, preferably consisting of titanium foils, are adhered to aperture windows 106*c* and 106*d*, respectively. A channel for passing trimmed tobacco T on perforated conveyor 103 is provided between thin metal films 106*e* and 106*f*. Shutter 106*g* is provided between radiation source 106*a* and aperture window 106*c*** to prevent leakage of radiation.

The operation of first radiometric density detector 106 will be described below.

When shutter 106g is open, the radiant rays emitted from radiation source 106a is transmitted through thin metal film 106e of aperture window 106c and is incident on trimmed tobacco T. The radiation rays are transmitted through trimmed tobacco T in accordance with the density of tobacco T and are incident on ionization box 106b through metal film 106f of aperture window 106d. The outer periphery of ionization box 106b is maintained at a high potential by high voltage power supply 106h, so that an ionization current corresponding to the measure density of trimmed tobacco T is generated, and this current is supplied to amplifier 106i.

A trimmer (not shown) is controlled and driven by this signal current. A detection output from first radiometric density detector 106 represents a density signal representing the density of the tobacco layer prior to formation of cigarettes.

Figure 3:
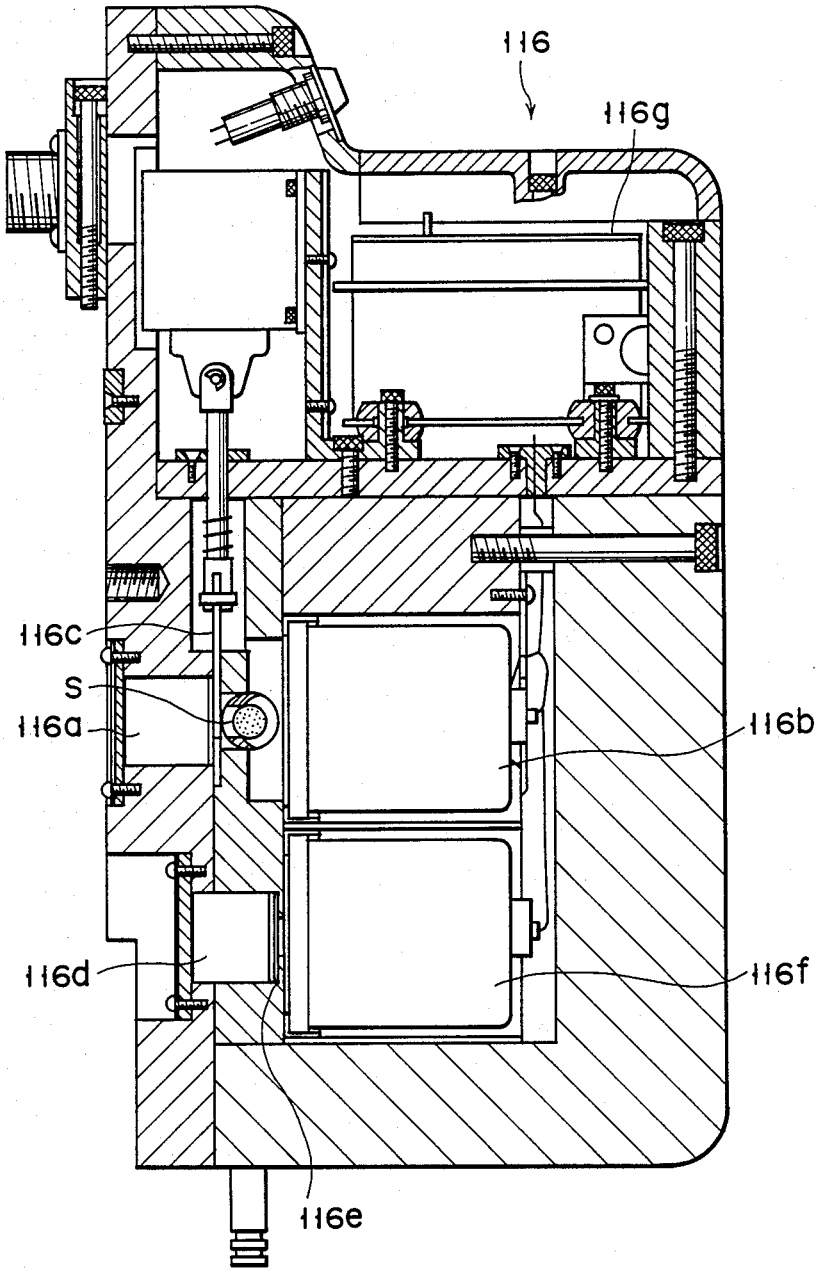
FIG. 3 is a sectional view showing a second radiometric density detector shown in FIG. 1.

FIG. 3 shows the construction of second radiometric density detector 116.

Detector 116 is similar to that which is used on known cigarette manufacturing machines as described above and mainly comprises radiation source 116a and ionization box 116b which oppose each other and are spaced apart from each other by a predetermined distance. Stick-like cigarette S is located between radiation source 116a and ionization box 116b. Shutter 116c for shielding radiation rays are provided between radiation source 116a and stick-like cigarette S. In addition to radiation source 116a and ionization box 116b which are used to detect the density of stick-like cigarette S, detector 116 also includes reference object 116e, radiation source 116d, and ionization box 116f, which are used to provide a target value of the cigarette density. Radiation source 116d and ionization box 116f oppose each other through reference object 116e. Ionization box 116f detects the density of reference object 116e and is electrically connected through lead wires to ionization box 116b for detecting the cigarette density.

The operation of the second radiometric density detector will be described below.

Radiation rays emitted from detector 116 are incident on stick-like cigarette S and are transmitted therethrough according to the cigarette density. The transmitted rays are incident on ionization box 116b. A negative voltage is applied by a high voltage power supply to the outer periphery of ionization box 116b. When the radiation rays are incident on ionization box 116b, an ionization current is generated according to an intensity of the incident ray.

The radiation rays from reference radiation source 116d are transmitted through reference object 116e and are incident on ionization box 116f. A positive voltage is applied from the high voltage power supply to the outer periphery of ionization box 116f. Upon reception of a radiant ray, ionization box 116f generates an ionization current corresponding to the target value. The ionization current generated upon application of the negative voltage to ionization box 116b and the ionization current generated upon application of the positive voltage to ionization box 116f are electrically coupled by the lead wires connected to the rear portions of ionization boxes 116b and 116f. A composite current is then supplied to amplifier 116g located in the upper portion of the detector. If stick-like cigarette S has the reference density, an output signal from amplifier 116g is set to zero. However, if the density of stick-like cigarette S is higher than the reference density, an output signal from amplifier 116g has a negative level; and if the density of stick-like cigarette S is lower than the reference density, an output signal from amplifier 116g has a positive level. Therefore, the output signal from amplifier 116g corresponds to a deviation in density of stick-like cigarette S from the reference density.

Figure 4:
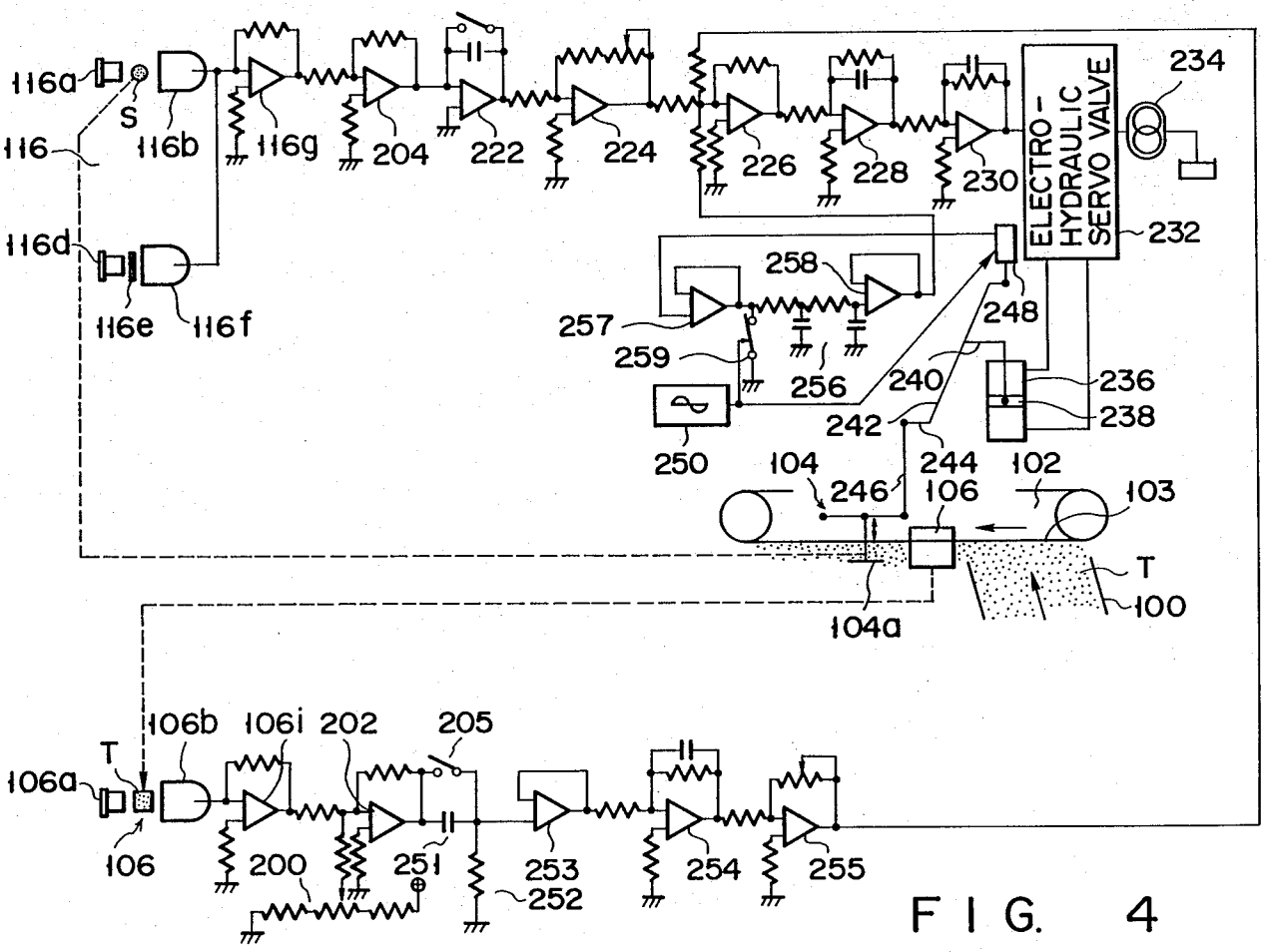
FIG. 4 is a circuit diagram of the tobacco content control device of the present invention.

FIG. 4 shows a control circuit of the tobacco content control device of this embodiment. The same reference numerals as in FIGS. 1 to 3 denote the same parts in FIG. 4.

As described above, cut tobacco T is sucked upward through chimney 100 and adhered in a stratiform on the lower side of perforated cigarette conveyor 103 which is located beneath suction chamber 102. Tobacco T is transferred in the arrowed direction, and the density of the tobacco layer is detected by first radiometric density detector 106. The radiation rays emitted for radiation source 106a provided in first radiometric density detector 106 are transmitted through tobacco T and incident on ionization box 106b. Since a high voltage is applied to ionization box 106b, a small ionization current is generated thereby. The small current signal is amplified by amplifier 106i and the amplified signal is added to the reference signal from standard signal generator 200. The sum signal is supplied to amplifier 202. An output signal as an amplified signal from amplifier 202 is a voltage signal having a polarity and a magnitude, both of which correspond to the deviation of the density of the tobacco layer from the reference density.

The cut tobacco, the density of which is detected by first radiometric density detector 106, is transferred to the left and excessive tobacco is shaved off by trimming disc 104a. Thereafter the tobacco is rolled in cigarette paper and glue is applied to the paper to form the stick-like cigarette. The density of the stick-like cigarette is measured by second radiometric density detector 116. As described above, in second radiometric density detector 116, radiation rays emitted from radiation source 116a are transmitted through stick-like cigarette S and incident on ionization box 116b. Radiation rays emitted from radiation source 116d are transmitted through reference object 116e and are incident on ionization box 106f. The voltages having opposite polarities are applied to the outer peripheries of ionization boxes 106b and 106f, and the rear portions of these ionization boxes are electrically connected to each other. An amplified output signal from amplifier 116g lserves as a voltage signal having a polarity and a magnitude, both of which represent a deviation of the measured density of stick-like cigarette S from the density of the reference object. An output signal from amplifier 116g is amplified by amplifier 204 and is integrated by integrator 222. The integrated output signal from integrator 222 represents a sum of signals corresponding to a deviation of the measured density of the stick-like cigarette from the reference density, i.e., the average deviation of the tobacco density. The operation terminal in the latter stage is driven such that the sum becomes zero, thereby always maintaining the density of the cigarette constant. The output signal from integrator 222 is amplified by amplifier 224 and is supplied as a second detection signal to adder 226.

The output signal from amplifier 202 is supplied to a high pass filter constituted by capacitor 251, resistor 252, and voltage follower 253. The filter is provided for allowing a high frequency component of the output signal to pass therethrough and preventing a low frequency component of the output signal, which is also contained in the output signal from amplifier 204, from passing therethrough. Thus, the instantaneous change of the output signal is delivered from the high pass filter. The time constant of this filter is preferably about one minute. Switch 205 is provided to inhibit the filter function during calibration.

The deviation detection signal free from the DC component is amplified by amplifiers 254 and 255, and the amplified signal is supplied to adder 226 as a first detection signal in the same manner as in the second detection signal.

A sum output from adder 226 is amplified by amplifier 228, and the amplified signal is further amplified by amplifier 230. The output from amplifier 230 is supplied to electrohydraulic servo valve 232. Electrohydraulic servo valve 232 selectively supplies the pressurized oil from gear pump 234 to the upper and lower chambers of cylinder 236 according to the applied voltage, thereby displacing piston 238 upward or downward within cylinder 236. The upward or downward movement of piston 238 is transmitted to trimming disc **104*a* of trimmer 104 through link 240, shaft 242, link 244, and connecting rod 246, to move trimming disc 104*a* upward or downward. The position of trimming disc 104*a* is detected by differential transformer 248 having a primary coil, which is applied with a reference alternative voltage signal of several kHz from oscillator 250 and has its center core connected to piston 238 through shaft 242 and link 240. Therefore, in response to the upward and downward movement of piston 238, a corresponding signal appears in the secondary coil of differential transformer 248 by a mutual induction coupling, and this signal is amplified by amplifier 257. Half-wave portions of the output from amplifier 257 are dropped off to ground by switch 259 which is operated by the output signal of amplifier 250, and the remaining half-wave portions are flattened by low pass filter 256. An output from amplifier 258 is applied to adder 226** as a third input signal.

With the above arrangement, when the sum of the first and second input signals of adder 226 is positive, that is to say, when the tobacco contents are deficient, a voltage appears at the output terminal of adder 226. As a result, the output from amplifier 230 is increased in a positive direction, so that electrohydraulic servo valve 232 slowly changes the flow of oil to push up piston 238, lowering trimming disk **104*a* through link 240, shaft 242, link 244, and connecting rod 246 to increase the tobacco content. Trimming disc 104*a*** is lowered until the third signal becomes equal to the sum of the signal (i.e., the first signal) from the first radiometric density detector and the signal (i.e., the second signal) from the second radiometric density detector. When the tobacco contents are excessive, the polarities in the foregoing operation are inverted.

The second signal generated by the above arrangement, i.e., the signal generated by second radiometric density detector 116 is obtained by integrating a signal corresponding to the density deviation by integrator 222. The first signal, i.e., the signal generated by first radiometric density detector 106 is a signal corresponding to the density deviation. Accordingly, when there is a difference between the first and second signals, the first signal may be dominant during a short time period, but the second signal is gradually increased by integration to a value which overwhelms the first signal. Therefore, the tobacco content can be determined and controlled according to the first signal with respect to variations of a short period and according to the second signal with respect to variations of a long period.

In this embodiment, first radiometric density detector 106 is arranged in the upstream side of trimmer 104 due to the following reason. In the practical control device, delay (delay time) occurs from the detection by the first radiometric density detector to driving of the trimmer on the basis of the detection signal. It is therefore difficult to accurately control the tobacco content of the cigarettes due to the delay time. In particular, in order to eliminate variations in higher frequencies, the delay time cannot be neglected. In the cigarette manufacturing machine, the first radiometric density detector is located in the upstream side of the trimmer, so that the first detection signal can be feedforwarded and the tobacco contents of cigarettes can be controlled.

Figure 5:
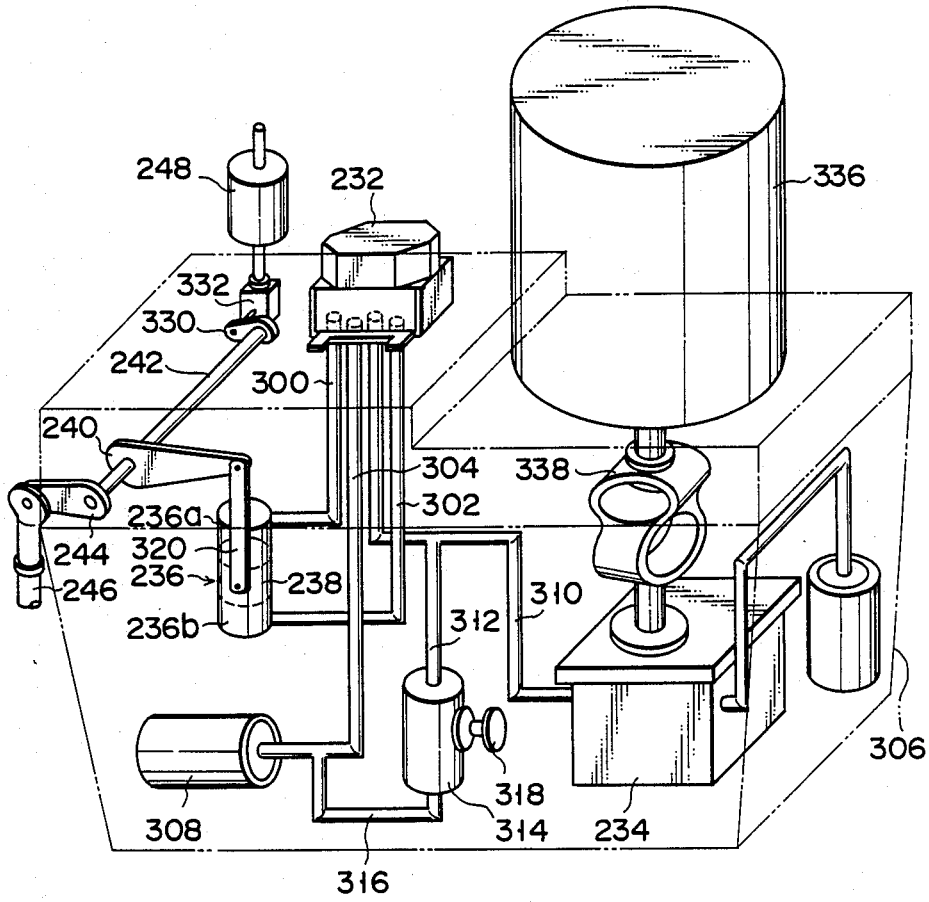
FIG. 5 is a perspective view of a hydraulic servo valve serving as a component of the tobacco content control device.

FIG. 5 shows a drive unit for driving trimming disc **104*a* controlling the thickness of the tobacco layer. Referring to FIG. 5, piston 238 is vertically slidable in cylinder 236 which is mounted on outer casing 306. Piston 238 is pushed down when pressurized oil is introduced into cylinder chamber 236*a* through pipe 300, oil in cylinder chamber 236*b* is drained into the tank through pipe 302 and return pipe 304. Similarly, when pressurized oil is introduced into cylinder chamber 236*b* to push piston 238 up, the oil in opposite cylinder chamber 236*a* is drained into the tank through pipe 300 and return pipe 304**.

The hydraulic system is kept at a predetermined oil pressure. When an oil pressure exceeding the preset pressure is applied from the gear pump, the oil pressure acts on relief valve 314 through pipe 312 connected midway along pipe 310 between gear pump 234 and electrohydraulic servo valve 232 and drained through return pipe 316 and filter 308. The pressure in the hydraulic system is controlled by pressure adjusting screw 318.

The upward and downward movement of piston 238 moves connecting rod 320 which is pivotally connected to piston 238. The other end of connecting rod 320 is pivotally connected to link 240, so that upward and downward movement of piston 238 causes link 240 to vertically rock along with shaft 242. Shaft 242 is axially supported by outer casing 306. The rocking movement is transmitted by shaft 242 to link 244 which is fixed to the end of shaft 242 to vertically move connecting rod 246 which is pivotally supported at the other end of the link 244. Trimming disc **104*a* is vertically moved by the upward and downward movement of connecting rod 246**.

Link 330 is axially supported at the other end of shaft 242 and is rockable upon rotation of shaft 242. Link 332 is attached to link 330 and is moved vertically upward and downward by the rocking movement of link 330. The center core of differential transformer 248 is fixed to link 332 so that the core can be vertically moved in the same manner as link 332.

For example, differential transformer 248 is adapted to produce a positive voltage when the core is moved upward and a negative voltage when the core is moved downward, in proportion to the distance of movement. In other words, differential transformer 248 generates a positive voltage when connecting rod 246 is moved upward and a negative voltage when connecting rod 246 is moved downward.

Motor 336 is connected to gear pump 234 through universal joint 338.

As described above, unlike the density detector utilizing air permeability properties or an electrostatic capacitance change, the second radiometric density detector according to the present invention can generate an accurate detection signal and performs very stable measurement. A deviation of the measured value from the target value is integrated, and the integrated value is fed back to accurately control the average density of the produced cigarettes.

Delay (delay time) occurs until the trimmer is started in response to the detection signal after the signal is measured by the radiographic density detector. This delay time degrades control performance because the control system undesirably oscillates when the response time is shortened to 1/5 or less of the idle time as the reference for the response of the control system as a whole is increased.

A device disclosed by U.S. Ser. No. 705,877 now U.S. Pat. No. 4,766,910 (Japanese Patent Disclosure (Kokai) No. 60-234574 and EPC Laid Open Publication No. 160,799) serves to improve response characteristics so as to minimize the delay time.

Feedforward control in the present invention is open loop control. The deviation from the target value cannot be integrated. However, the response time of the control system can be shortened to a time required for feeding the cut tobacco between the radiometric density detector as the detection terminal and the trimmer as the operation terminal.

An arrangement of feedforward control is described in Japanese Patent Publication No. 40-14560, wherein pressure variations in the air chamber are converted by a bellows into variations in position, and the variations are feedforwarded by a hydraulic unit. However, precision of the signal is poor, and a satisfactory effect cannot be obtained.

According to the present invention, the advantages of feedback control of the radiometric density detector, the electrohydraulic servo mechanism operated as an operation terminal with a short response time, and feedforward control are combined to obtain an ideal control system operated at high speed in response to the detection signal.

As a result, the response speed of the control device can be improved by about 10 times that of the conventional control device. Although the irregularities of the tobacco content of cigarettes are given to be normally about 2.5%, the present invention can reduce the irregularities below 2.0%.

In other words, the weight of the cigarette is normally calculated as follows:

$$\text{Weight} = (\text{Defective Limit}) - 3.0 \times \text{Variation}$$

Therefore, the tobacco contents can be reduced by about 1.5%.

As described above, a very high-speed control system can be arranged according to the present invention, and the irregularities of the tobacco content of cigarettes can also be minimized.

What is claimed is:

1. A system for controlling content of tobacco on a cigarette manufacturing machine, comprising:

conveying means for attracting and conveying shredded tobacco thereon;

trimming means for removing an excessive amount of shredded tobacco conveyed by said conveying means, to regulate an amount of shredded tobacco;

tobacco wrapping means for transferring the tobacco trimmed by said trimming means onto continuous tobacco roll paper and for wrapping the trimmed tobacco in the tobacco roll paper to make a stick-like cigarette;

first radiometric density detecting means for continuously detecting a density of the shredded tobacco by means of radiation rays, before the tobacco enters said trimming means, to generate a first detection signal representing a difference between a measured density of shredded tobacco and a first reference density;

second radiometric density detecting means for detecting a density of the stick-like cigarettes continuously formed by said tobacco wrapping means, to generate a second detection signal representing a difference between a measured density of the stick-like cigarette and a second reference density;

a feedforward open loop control means connected to said first radiometric density detecting means, for generating a feedforward control signal corresponding to an instantaneous change of the first detection signal;

a feedback loop control means connected to said second radiometric density detecting means, for generating a feedback control signal corresponding to an average change of the second detection signal; and driving means for driving said trimming means in response to said feedforward control signal and said feedback control signal.

2. A system according to claim 1, wherein said feedback loop control means includes means for integrating the second detection signal.

3. A system according to claim 1, wherein said feedforward open loop control means includes filtering means for allowing a high frequency component of the first detection signal to pass therethrough.

4. A system according to claim 1, further comprising means for adding said feedback control signal and said feedforward control signal, a output signal from said adding means coupled to said driving means to control said trimming means.

5. A system according to claim 1, wherein said driving means includes an electrohydraulic servo valve for moving said trimming means.

6. A system according to claim 1, wherein said trimming means includes a trimmer for regulating the tobacco.

7. A system according to claim 4, wherein said driving means includes means detecting the movement of said trimmer for generating a third signal and said adding means adds said third signal to said feedback control signal and said feedforward control signal.

* * * * *